US009976748B2

(12) United States Patent
Herzog

(10) Patent No.: US 9,976,748 B2
(45) Date of Patent: May 22, 2018

(54) ROTATABLE SWITCH FOR APPLIANCE VALVE

(71) Applicant: ILLINOIS TOOL WORKS INC., Glenview, IL (US)

(72) Inventor: Richard R. Herzog, Arlington Heights, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 709 days.

(21) Appl. No.: 14/327,845

(22) Filed: Jul. 10, 2014

(65) Prior Publication Data

US 2015/0059733 A1 Mar. 5, 2015

Related U.S. Application Data

(60) Provisional application No. 61/873,178, filed on Sep. 3, 2013.

(51) Int. Cl.

| | |
|---|---|
| ***H01H 19/36*** | (2006.01) |
| ***H01H 19/03*** | (2006.01) |
| ***F24C 3/10*** | (2006.01) |
| ***G05G 5/06*** | (2006.01) |
| *G05G 1/08* | (2006.01) |

(52) U.S. Cl.

CPC ..... *F24C 3/10* (2013.01); *G05G 5/06* (2013.01); *G05G 1/08* (2013.01)

(58) Field of Classification Search

CPC ... F24C 3/10; G05G 5/06; G05G 5/08; G05G 5/28; G05G 1/08; H01H 19/36; H01H 3/0206

USPC ..... 126/39 E; 200/61.86; 431/132

See application file for complete search history.

(56) References Cited

U.S. PATENT DOCUMENTS

| | | | | |
|---|---|---|---|---|
| 3,019,667 | A * | 2/1962 | Bann | G05G 5/06 74/526 |
| 3,122,616 | A * | 2/1964 | Rice | D06F 33/02 137/625.46 |
| 3,770,363 | A * | 11/1973 | Friedrich | F23Q 9/08 431/255 |
| 3,809,830 | A * | 5/1974 | Lockard | G01D 5/25 200/11 TW |
| 3,912,886 | A * | 10/1975 | Allen | H01H 1/16 200/11 A |
| 4,025,738 | A * | 5/1977 | Erwin | H01H 11/06 200/238 |

(Continued)

FOREIGN PATENT DOCUMENTS

ES 1078344 U 1/2013

*Primary Examiner* — Steven B McAllister
*Assistant Examiner* — Steven Anderson, II
(74) *Attorney, Agent, or Firm* — Boyle Fredrickson, SC

(57) ABSTRACT

Embodiments of the invention provide a switch for use with an appliance valve, such as for gas appliances. The switch may comprise a base for coupling the switch to a valve, a rotatable hub in communication with the base and providing rotation therewith, a first protrusion projecting outwardly from the hub, and a detent disposed on the base and in communication with the first protrusion for resisting rotatable motion of the hub. Rotation of the hub in a first direction for turning an appliance valve to an on position requires the first protrusion to flexibly deflect the detent to permit the hub to rotate past the detent. As a result, danger of inadvertent rotation of the switch is reduced.

17 Claims, 7 Drawing Sheets

(56) References Cited

U.S. PATENT DOCUMENTS

| | | | | |
|---|---|---|---|---|
| 4,038,508 | A * | 7/1977 | Mapelsden | G05G 5/06 200/17 R |
| 4,371,764 | A * | 2/1983 | Runion | H01H 3/0206 200/61.86 |
| 7,420,142 | B2 * | 9/2008 | Barrena | H01H 19/62 219/448.11 |
| 2009/0321231 | A1 * | 12/2009 | Tegel | H01H 1/585 200/16 D |

* cited by examiner

ROTATABLE SWITCH FOR APPLIANCE VALVE

CROSS REFERENCE TO RELATED APPLICATION

This Non-Provisional Application claims benefit to U.S. Provisional Application Ser. No. 61/873,178 filed Sep. 3, 2013 hereby incorporated by reference.

FIELD OF THE INVENTION

The present invention relates to rotatable switches and in particular to rotatable switches for appliance valves, such as taps for gas kitchen appliances.

BACKGROUND OF THE INVENTION

Many kitchen appliances, such as gas ovens, broilers, burners, and so forth, are controlled by an operator via one or more rotatable switches. Rotation of a switch in a first direction, such as counter clockwise, typically turns the appliance "on" while rotation of the switch in a second direction, such as clockwise, typically turns the appliance "off" with a spectrum of intensities between. The rotatable switch is oftentimes coupled to a valve and/or ignition system such that rotation of the switch to turn the appliance on permits one or more of: gas to flow; an electrical spark; heating an electrical element; and/or any other action associated with being on.

Modern kitchen designs commonly locate such appliances below useful areas, such microwave ovens, cupboards or other common structures or devices. However, if a user inadvertently leans against the appliance in reaching for an area above, the user may accidentally turn the rotatable switch to an on position, which may thereby cause a gas leak, burning or other hazardous condition.

Some attempts to address such accidental rotation include providing a channel beneath the rotatable switch that snaps into position with a fixed opposing element. However, rotating the switch past the opposing element then results in permanently requiring increased torque to rotate the switch in any direction due to continuous friction between the switch and the opposing element. Moreover, such friction oftentimes results in annoying squeaks as the switch drags across the opposing element. Consequently, there is a need to provide a safety mechanism to help reduce the dangers of accidental rotation without the aforementioned drawbacks.

SUMMARY OF THE INVENTION

In accordance with aspects of the invention, a hub with an associated projection (or protrusion) is configured to rotate. A detent is located on a flexible arm in which the detent is configured to cooperate with the projection. As a result, the detent and the projection combination provide a mechanism to increase the forces needed to rotate the hub beyond an initial position.

By providing a projection on a side of the hub such that the projection rotates with the hub past the detent, which detent is spaced from the body of the hub, the hub is allowed to freely rotate once past the detent, without continuous interference from or friction with the detent. As a result, a mechanism is provided in which the dangers of accidental rotation may be reduced without the disadvantages of permanently requiring increased torque or producing annoying squeaks.

In a preferred embodiment, there may be two projections, or multiple lobes, or multiple surfaces of a single lobe, and one of the projections may be larger than the other. A smaller projection may aid in retaining the hub in a "0," or "off," position, such as during shipment prior to assembly of the switch to a gas valve. The larger projection may provide an additional force component that must be overcome to turn the valve to an "on" position so as to reduce the likelihood of the valve being accidentally turned on. The same force may be required to subsequently turn the valve back off.

An embodiment of the present invention may provide a switch for use with an appliance valve comprising: a base for coupling the switch to an appliance valve; a rotatable hub in communication with the base and providing rotation therewith; a first protrusion projecting outwardly from the hub; and a detent disposed on the base and in communication with the first protrusion for resisting rotatable motion of the hub. Rotation of the hub in a first direction for turning the switch to an on position requires the first protrusion to flexibly deflect the detent to permit the hub to rotate past the detent. When the switch is in the on position, the hub is free from contact with the detent.

The switch may further comprise a second protrusion projecting outwardly from the hub and in communication with the detent, wherein the second protrusion resists rotatable motion of the hub in a second direction.

It is thus a feature of at least one embodiment of the invention to provide a mechanism for preventing the switch from turning in either direction inadvertently.

The detent may be positioned between the first and second protrusions for maintaining an appliance valve in an off position.

It is thus a feature of at least one embodiment of the invention to provide a mechanism for retaining the hub in a "0," or off, position, such as during shipment prior to assembly.

The first protrusion may be larger than the second protrusion.

It is thus a feature of at least one embodiment of the invention to require a greater amount of force to turn the valve to an on position than to move the valve past a "0"or off position.

The first and/or second protrusions may be generally shaped as one or more lobes and/or may be manufactured from plastic.

It is thus a feature of at least one embodiment of the invention to provide a mechanism with ease of manufacture, assembly and use.

A flexible arm may be disposed on the base, and the detent may be disposed on the flexible arm.

It is thus a feature of at least one embodiment of the invention to provide an effective technique for deflecting the detent with an appropriate amount of additional force.

The switch may be an ignition switch for a gas appliance valve, wherein turning to the on position produces an electrical spark and permits gas to flow.

It is thus a feature of at least one embodiment of the invention to provide a mechanism that substantially improve gas appliance activation.

Other features and advantages of the invention will become apparent to those skilled in the art upon review of the following detailed description, claims and drawings in which like numerals are used to designate like features.

Figure 1:
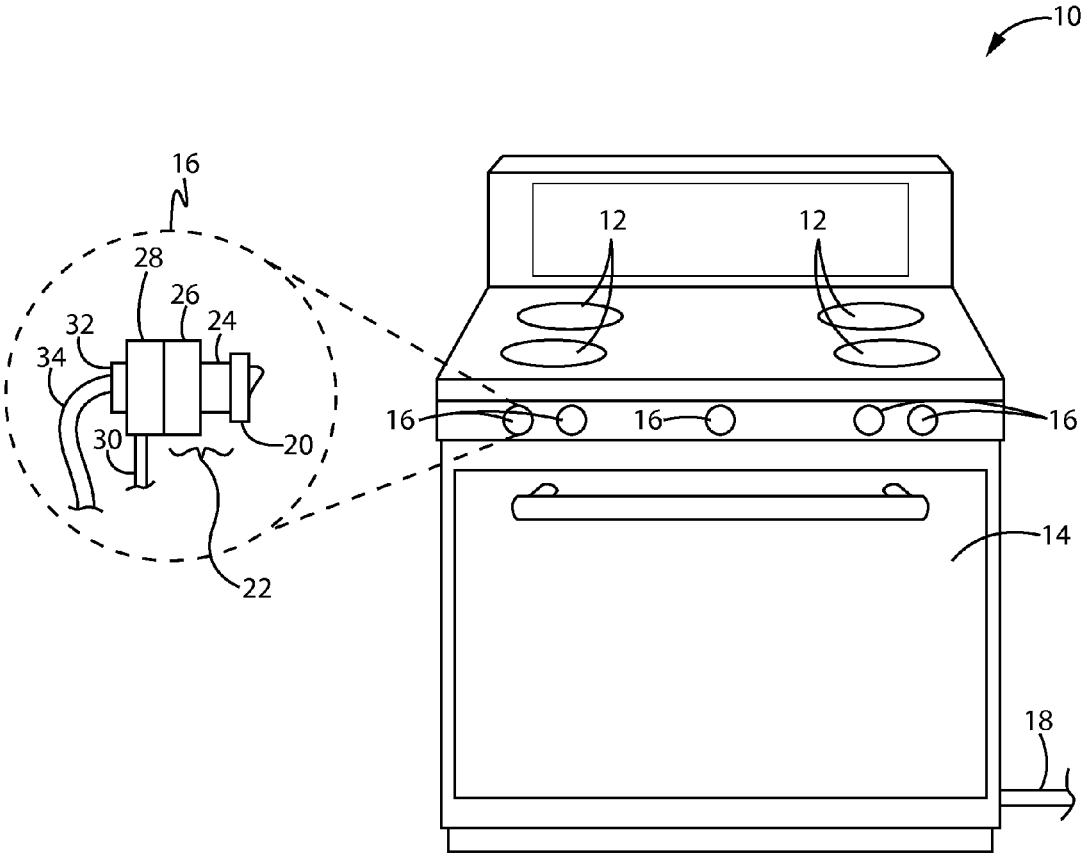
FIG. 1 is an exemplar system diagram of a gas appliance including a plurality of rotatable switches provided in accordance with an embodiment of the invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to the exemplar system diagram of FIG. 1, a gas appliance 10 includes a plurality of burners 12 and an oven 14 that are individually controllable by a plurality of rotatable switch and valve arrangements 16. A gas line 18 connected to the appliance 10 provides a source of fuel or gas, such as natural gas or propane, for the burners 12 and the oven 14. The source of gas may be individually controllable to each of the burners 12 and the oven 14 via respective switch and valve arrangements 16.

Each switch and valve arrangement 16 may comprise, for example, a knob 20 visible by a user coupled to a switch 22, which may be manufactured from hardened plastics, comprising a rotatable hub 24 and a base 26. The switch 22, in turn, may couple to an appliance valve (and stem) 28 for controlling a flow of gas through an individual gas line 30 for one of the particular burners 12 or the oven 14. In addition, an ignition system 32 may be coupled to the switch 22, which coupling may occur through the valve 28, for providing electrical contacts to produce an electrical spark via wiring 34 to ignite the corresponding burner 12 or oven 14 when turned on.

Figure 2:
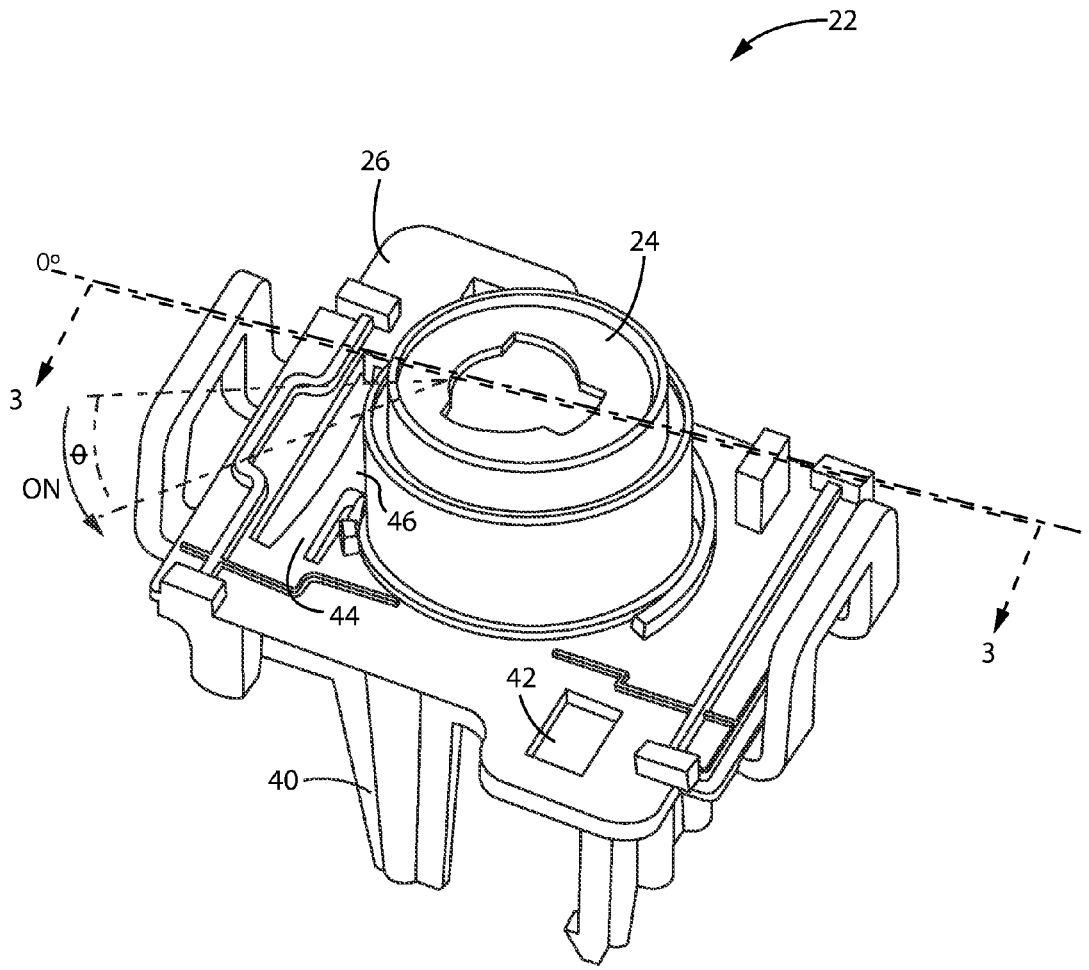
FIG. 2 is a top perspective view of a rotatable switch in accordance with an embodiment of the invention.
Figure 3:
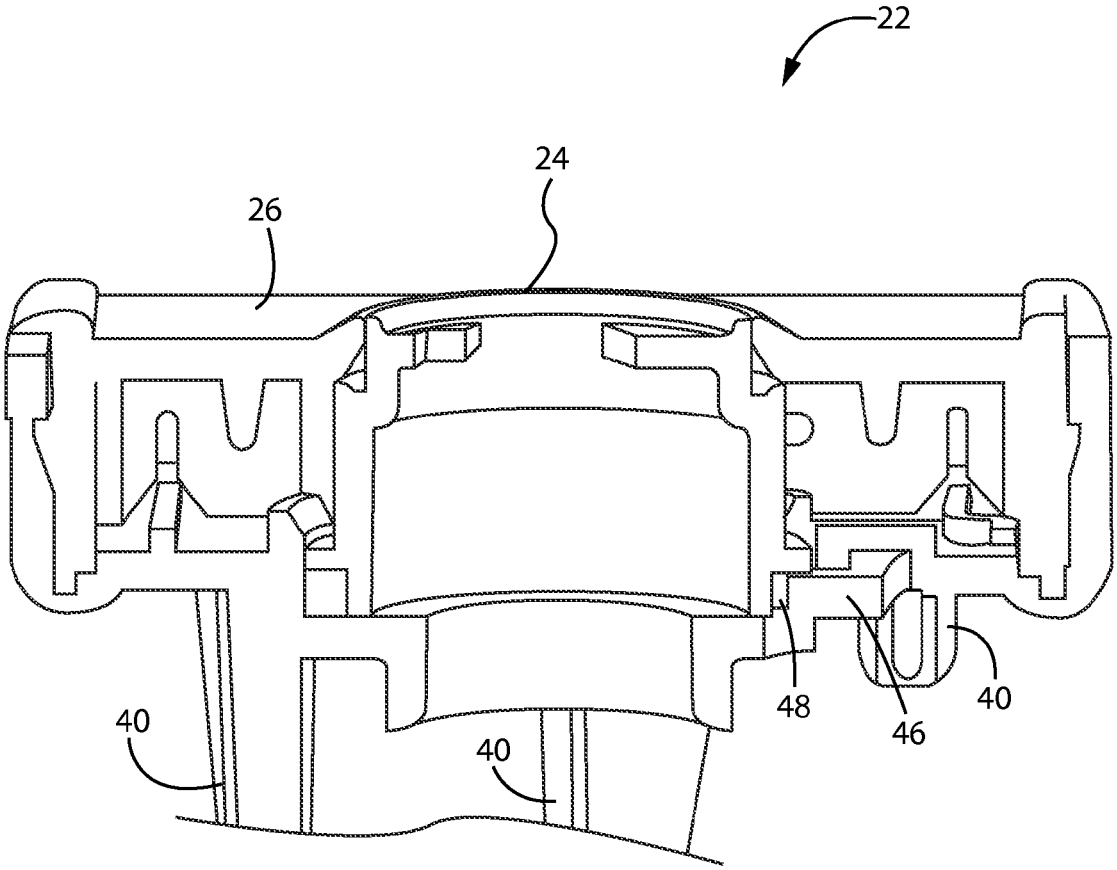
FIG. 3 is a sectional view of the switch of FIG. 2 taken along the line 3-3.

Referring now to FIG. 2, a top perspective view of a switch 22 is provided in accordance with an embodiment of the invention. The base 26 of the switch 22 may provide a plurality of posts 40 and apertures 42 for coupling the base 26, and consequently coupling the switch 22, to the valve 28. The base 26 also includes a flexible arm 44 disposed on the base 26, and a detent 46 disposed on the flexible arm 44. The rotatable hub 24 is in communication with the base 26 and provides rotation therewith. Accordingly, while the base 26 remains fixed with respect to the valve 28, and therefore with respect to the appliance 10, the rotatable hub 24 may rotate for the user to affect control. A sectional view of the switch 22 taken along the line 3-3 is provided in FIG. 3.

Figure 4:
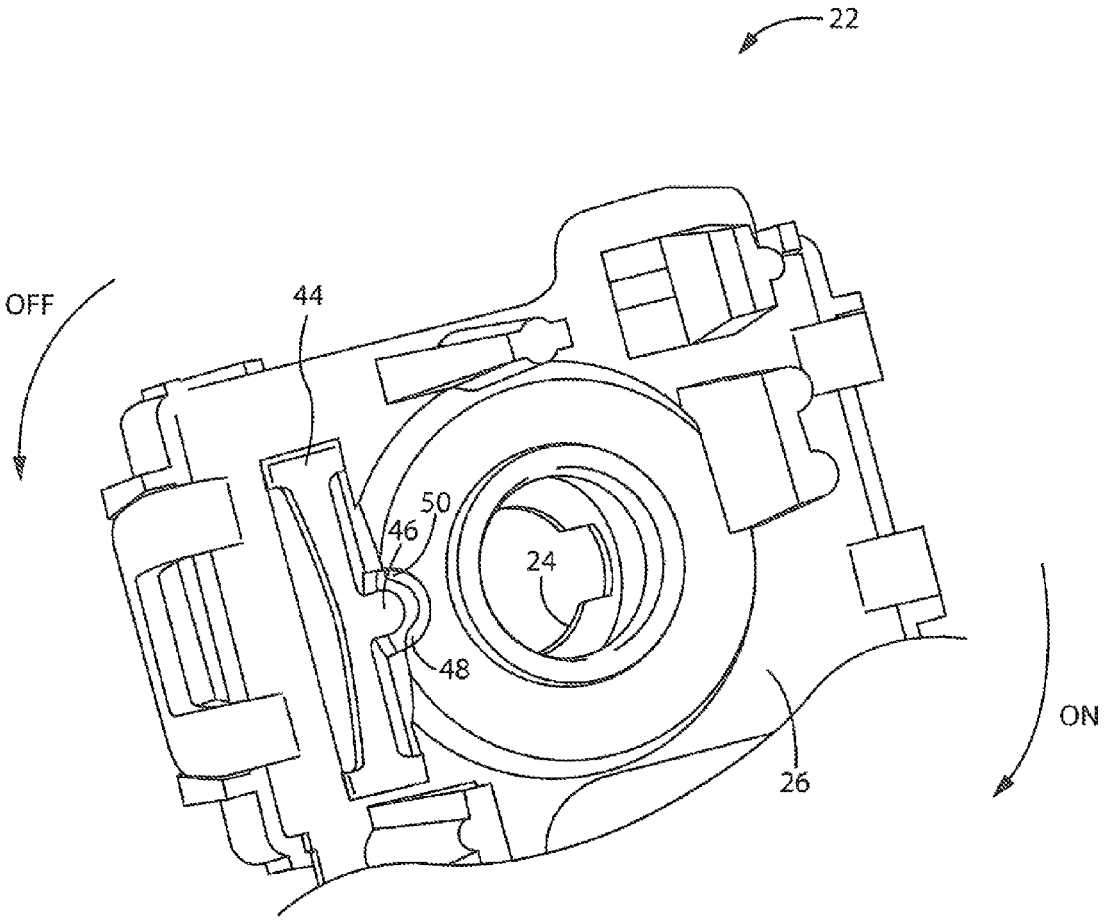
FIG. 4 is a bottom perspective view of the switch of FIG. 2.

Referring now to FIG. 4, a bottom perspective view of the switch of FIG. 2 is provided in accordance with an embodiment of the invention. The rotatable hub 24 includes a first protrusion 48 projecting outwardly from the hub 24. The detent 46 is in communication with the first protrusion 48 for resisting rotatable motion of the hub 24 in a first ("on") direction. As such, the detent 46 interacts and cooperates with the first protrusion 48 to increase the forces needed to rotate the hub 24 in the first direction to turn the valve on.

In some embodiments, the rotatable hub 24 may also include a second protrusion 50 projecting outwardly from the hub 24. Accordingly, the detent 46 may also be in communication with the second protrusion 50 for resisting rotatable motion of the hub 24 in a second ("off") direction. As such, the detent 46 also interacts and cooperates with the second protrusion 50 to increase the forces needed to rotate the hub 24 in the second direction to turn beyond the off position. Advantageously, the detent 46 may be positioned between the first and second protrusions 48 and 50 for maintaining the valve 28 in a "0" position, such as during shipment prior to assembly, or an off position.

Rotation of the hub 24 in the first direction, for turning the valve 28 to on, requires the first protrusion 48 to flexibly deflect the detent 46 to permit the hub 24 to rotate past the detent 46. Conversely, for embodiments including the second protrusion 50, rotation of the hub 24 in the second direction, for turning the valve 28 past the off position, requires the second protrusion 50 to flexibly deflect the detent 46 to permit the hub 24 to rotate past the detent 46. Because the body of the hub 24 is free from contact with the detent when the switch 22 is in the on position, the switch 22 does not permanently require increased torque to rotate, or produce annoying squeaks with rotation.

Referring back to FIG. 2, in operation, the rotatable hub 24 may begin in the off position at an angular position of 0° with respect to the base 26, such as with the detent 46 positioned between the first and second protrusions 48 and 50. The hub 24 may then rotate in the first direction, which may be counter clockwise, toward the on position. In doing so, a force component must be overcome for the first protrusion 48 to flexibly deflect the detent 46, which may be facilitated by the flexible arm 44, for the hub 24 to rotate past the detent 46 to the on position.

Next, between first and second counter clockwise angles of rotation defining an angle θ past the detent 46, which may be, for example, between 25° and 70° with respect to the base 26, the switch 22 may cause the valve 28 to permit gas to flow through the individual gas line 30 for one of the particular burners 12 or oven 14. In addition, between the first and second counter clockwise angles of rotation, the switch 22 may also cause the ignition system 32 to produce an electrical spark via the wiring 34 to ignite the corresponding burner 12 or oven 14. Continuing to rotate the hub 24 in the first direction past the second counter clockwise angle of rotation may increase the intensity of the corresponding burner 12 or oven 14 by further increasing the flow of gas. Conversely, rotating the rotatable hub 24 in the second direction back toward 0° may ultimately return to the off position by inhibiting the flow of gas.

Figure 5:
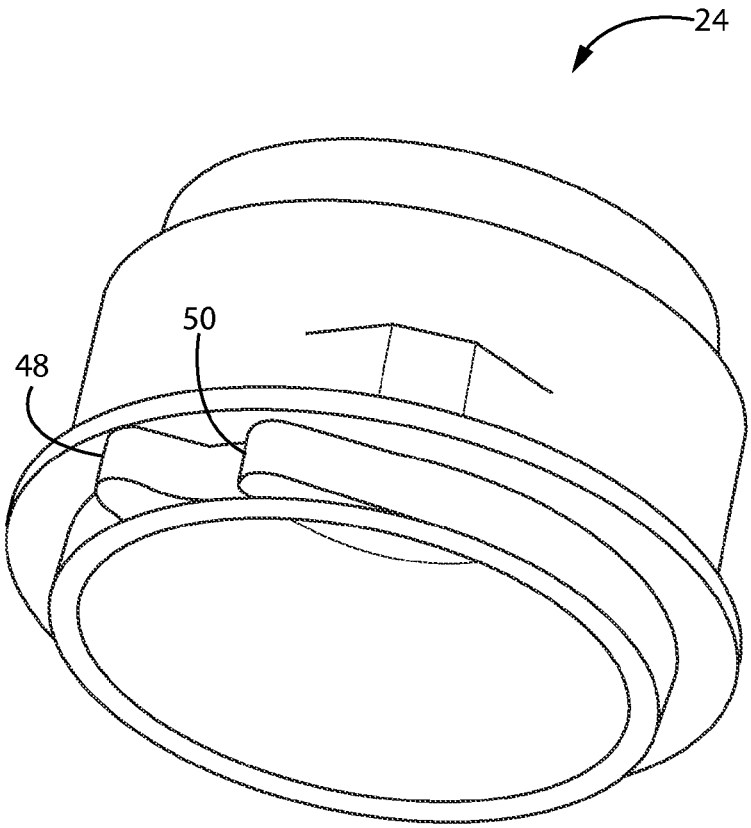
FIG. 5 is a perspective view of a hub for the switch of FIG. 2.

Referring now to FIG. 5, a perspective view of the rotatable hub 24 for the switch 22 is provided in accordance with an embodiment of the invention. In an embodiment, the first protrusion 48 may be larger than the second protrusion 50. As such, the detent 46 may provide greater resistance to rotatable motion of the hub 24 for turning an appliance valve to an on position. Also, in some embodiments, the first and/or second protrusions 48 and 50 may be generally shaped as multiple lobes or as a single lobe with multiple surfaces.

Figure 6:
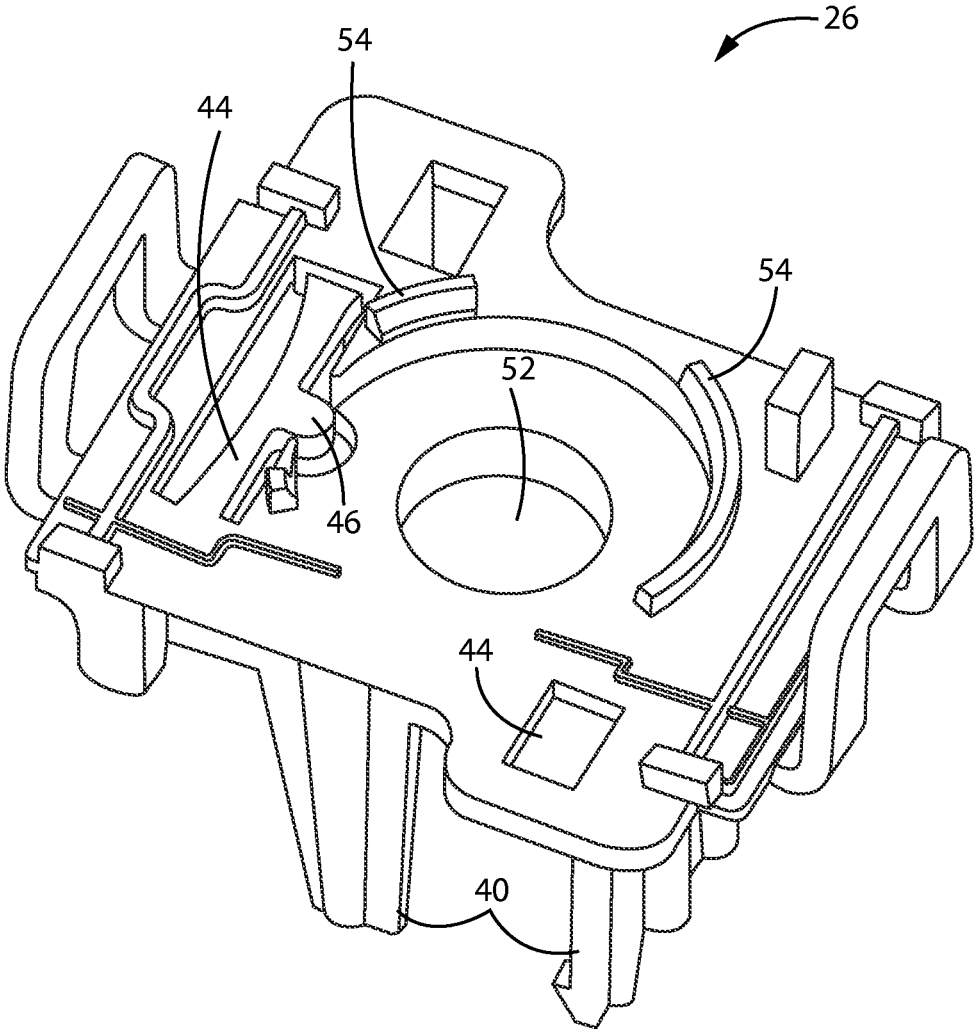
FIG. 6 is a perspective view of a base for the switch of FIG. 2.

Referring now to FIG. 6, a perspective view of the base 26 for the switch 22 is provided in accordance with an embodiment of the invention. The base 26 may provide a central aperture 52 for the hub 24 to couple to the base 26 and, in turn, to an appliance valve and stem. Also, the base 26 may include circumferential edges for positively retaining the hub 24 in position while permitting the hub 24 to rotate.

Figures 7A, 7B, 7C, 7D:
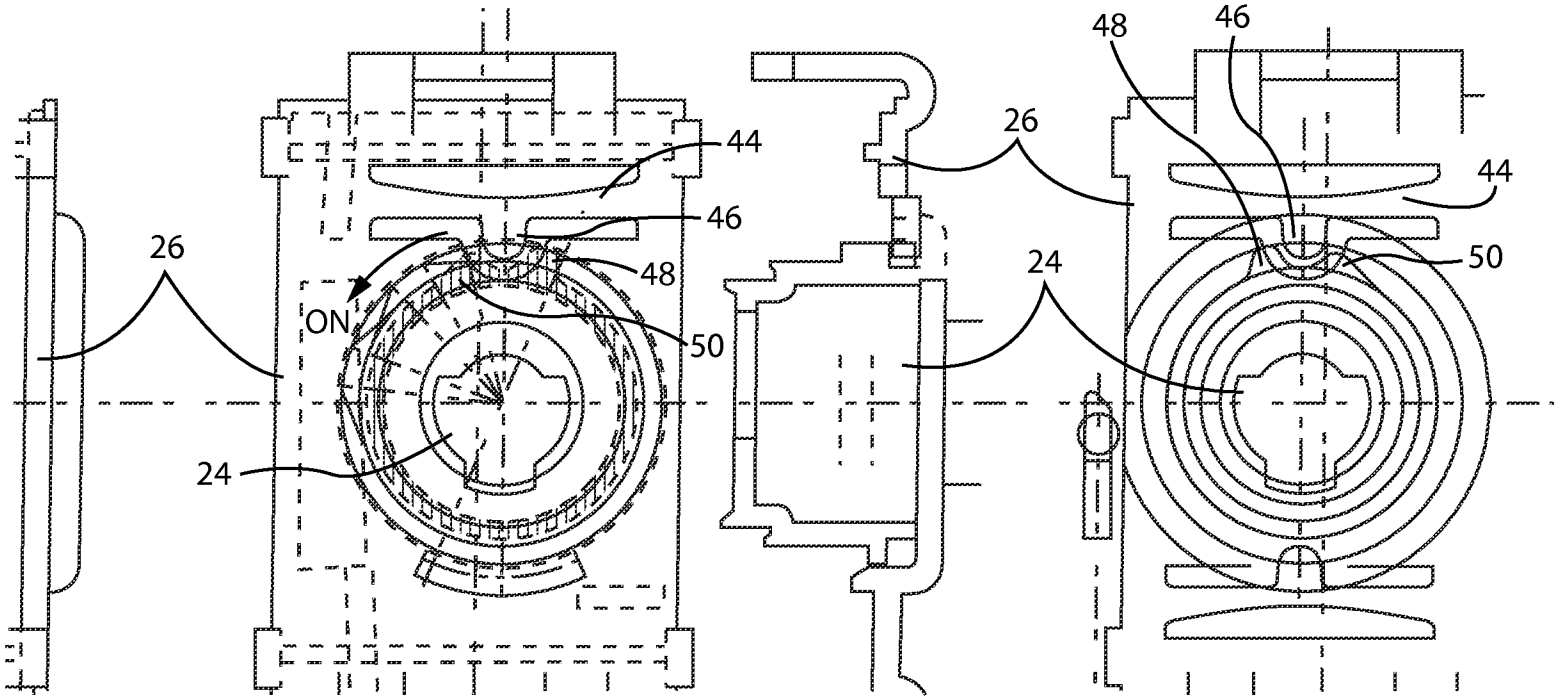
FIG. 7A is a simplified front view.
FIG. 7B is a simplified back view.
FIG. 7C is a simplified first side view.
FIG. 7D is a simplified second side view, each for a rotatable switch in accordance with an embodiment of the invention.

Referring now to FIGS. 7A-7D, simplified views of the rotatable switch 22 is provided in accordance with an embodiment of the invention. FIG. 7A provides a simplified front view, FIG. 7B provides a simplified back view, FIG. 7C provides a simplified first side view, and FIG. 7D provides a simplified second side view.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

The present invention may provide a safety mechanism to help reduce the danger of inadvertent or accidental rotation of a rotatable switch. Nevertheless, the term "safety," "safely" or "safe" as used herein is not a representation that the present invention will make the environment safe or that other systems will produce unsafe operation. Safety may depend on a wide variety of factors outside of the scope of the present invention. Although the present invention is intended to be highly reliable, all physical systems are susceptible to failure and provision must be made for such failure.

What is claimed is:

1. A switch for use with a gas appliance valve, the switch having an on position operable to permit gas to flow and an off position operable to inhibit the flow of gas, the switch comprising:

a base for coupling the switch to an appliance valve;

a rotatable hub retained by the base and providing rotation therewith;

first and second protrusions projecting outwardly from the hub; and a detent disposed on the base for resisting rotatable motion of the hub via the first second protrusions;

wherein the detent is between the first and second protrusions when the switch is in the off position, wherein the first and second protrusions resist any rotation of the hub when the detent is between the first and second protrusions, wherein rotation of the hub in a first direction from the off position requires the first protrusion to flexibly deflect the detent to permit the hub to rotate past the detent in the first direction, wherein rotation of the hub in a second direction from the off position requires the second protrusion to flexibly deflect the detent to permit the hub to rotate past the detent in the second direction, and wherein the hub is free from contact with the detent when rotated to the on position.

2. The switch of claim 1, wherein the first protrusion resists rotatable motion of the hub in the first direction by a greater amount than the second protrusion resists rotatable motion of the hub in the second direction.

3. The switch of claim 2, wherein the first protrusion is larger than the second protrusion.

4. The switch of claim 2, wherein the first and second protrusions are lobes.

5. The switch of claim 1, wherein the base includes a flexible arm, and the detent is disposed on the flexible arm.

6. The switch of claim 1, wherein the switch is an ignition switch for a gas appliance valve, wherein turning the switch to the on position produces an electrical spark and permits gas to flow.

7. The switch of claim 1, wherein the first protrusion is a plastic lobe.

8. An ignition switch for use with a gas appliance valve, the ignition switch having an on position operable to permit gas to flow and an off position operable to inhibit the flow of gas, the ignition switch comprising:

a base for coupling the ignition switch to a gas appliance valve, the base including:

a flexible arm;

a rotatable hub retained by the base and providing rotation therewith;

first and second protrusions projecting outwardly from the hub; and a detent disposed on the flexible arm for resisting rotatable motion of the hub via the first and second protrusions;

wherein the detent is between the first and second protrusions when the ignition switch is in the off position, wherein the first and second protrusions resist any rotation of the hub when the detent is between the first and second protrusions, wherein rotation of the hub in a first direction from the off position requires the first protrusion to flexibly deflect the detent to permit the hub to rotate past the detent in the first direction, wherein rotation of the hub in a second direction from the off position requires the second protrusion to flexibly deflect the detent to permit the hub to rotate past the detent in the second direction, wherein the hub is free from contact with the detent when rotated to the on position, and wherein turning the switch to the on position produces an electrical spark.

9. The ignition switch of claim 8, wherein the first protrusion resists rotatable motion of the hub in the first direction by a greater amount than the second protrusion resists rotatable motion of the hub in the second direction.

10. The ignition switch of claim 9, wherein the first protrusion is larger than the second protrusion.

11. The switch of claim 9, wherein the first and second protrusions are lobes.

12. A gas appliance comprising:

at least one of an oven and a burner;

a gas line for providing gas to the at least one of an oven and a burner;

a valve for controlling a flow of gas through the gas line; and a switch for controlling the valve, the switch having an on position operable to permit gas to flow and an off position operable to inhibit the flow of gas, the switch comprising:

(a) a base for coupling the switch to the valve;

(b) a rotatable hub retained by the base and providing rotation therewith;

(c) first and second protrusions projecting outwardly from the hub; and (d) a detent disposed on the base for resisting rotatable motion of the hub via the first and second protrusions;

wherein the detent is between the first and second protrusions when the switch is in the off position, wherein the first and second protrusions resist any rotation of the hub when the detent is between the first and second protrusions, wherein rotation of the hub in a first direction from the off position and permitting gas to flow requires the first protrusion to flexibly deflect the detent to permit the hub to rotate past the detent in the first direction, wherein rotation of the hub in second direction from the off position requires the second protrusion to flexibly deflect the detent to permit the hub to rotate past the detent in the second direction, and wherein the hub is free from contact with the detent when rotated to the on position.

13. The gas appliance of claim 12, wherein the first protrusion resists rotatable motion of the hub in the first direction by a greater amount than the second protrusion resists rotatable motion of the hub in the second direction.

14. The gas appliance of claim 13, wherein the first protrusion is larger than the second protrusion.

15. The gas appliance of claim 14, wherein the first and second protrusions are lobes.

16. The gas appliance of claim 12, wherein the base includes a flexible arm, and the decent is disposed on the flexible arm.

17. The gas appliance of claim 12, further comprising an ignition system coupled to the switch, wherein turning to the on position produces an electrical spark.

* * * * *